US009375080B2

(12) United States Patent
Glekas

(10) Patent No.: US 9,375,080 B2
(45) Date of Patent: Jun. 28, 2016

(54) MODULAR DISPLAY CASE

(71) Applicant: Athanasi Glekas, Olney, MD (US)

(72) Inventor: Athanasi Glekas, Olney, MD (US)

( * ) Notice: Subject to any disclaimer, the term of this patent is extended or adjusted under 35 U.S.C. 154(b) by 0 days.

(21) Appl. No.: 14/723,541

(22) Filed: May 28, 2015

(65) Prior Publication Data

US 2015/0342341 A1 Dec. 3, 2015

Related U.S. Application Data

(60) Provisional application No. 62/003,614, filed on May 28, 2014.

(51) Int. Cl.

| | |
|---|---|
| ***A47B 43/00*** | (2006.01) |
| ***A47B 47/00*** | (2006.01) |
| ***A47F 5/10*** | (2006.01) |

(52) U.S. Cl.

CPC ..... *A47B 47/0091* (2013.01); *A47B 43/00* (2013.01); *A47F 5/10* (2013.01); *Y10T 29/49828* (2015.01); *Y10T 29/49948* (2015.01)

(58) Field of Classification Search

CPC .. A47B 87/005; A47B 87/007; A47B 87/008; A47B 87/02; A47B 87/0215; A47B 87/0276; A47B 87/0284; A47B 47/0091; A47B 47/0075; A47B 43/00; A47B 87/0292

USPC ..... 312/114, 107, 108, 111, 258, 262, 324, 312/326, 329

See application file for complete search history.

(56) References Cited

U.S. PATENT DOCUMENTS

| | | | | | |
|---|---|---|---|---|---|
| 498,178 | A | * | 5/1893 | Leonard | B65D 43/164 16/355 |
| 1,212,429 | A | * | 1/1917 | Weinstein | B65D 7/26 220/6 |
| 1,934,380 | A | * | 11/1933 | Schmitz | A47B 63/02 312/108 |
| 2,083,114 | A | * | 6/1937 | Blechman | A47B 43/02 229/120.011 |
| 2,240,729 | A | * | 5/1941 | Von Palmenberg | A47F 3/005 126/9 B |
| 2,299,766 | A | * | 10/1942 | Rosenthal | A47B 47/05 312/259 |
| 2,550,088 | A | * | 4/1951 | Sayer | B65D 7/26 220/6 |
| 2,676,861 | A | * | 4/1954 | Belew | G11B 33/0444 220/23.6 |
| 3,391,824 | A | | 7/1968 | Wiseman | |
| 3,552,579 | A | * | 1/1971 | Simon | A47B 87/02 206/821 |
| 4,128,286 | A | | 12/1978 | Windisch et al. | |
| 4,747,644 | A | * | 5/1988 | Gallery | A47B 43/00 312/140 |
| 5,261,848 | A | | 11/1993 | Kaplan et al. | |

(Continued)

OTHER PUBLICATIONS

Crate&Barrel Sloane Leaning Desk/Bureau Incline/Escritorio Inclinado, crateandbarrel.com.

*Primary Examiner* — Janet M Wilkens
(74) *Attorney, Agent, or Firm* — Edell, Shapiro & Finnan, LLC

(57) ABSTRACT

A modular display case includes a base, a top, and foldable outer wall extending therebetween. The base, top, and foldable outer wall collectively provide an internal cavity configured to receive objects for display. The foldable wall includes a door to allow objects to be inserted into or removed from the internal cavity and the door may open right or left. The modular display and pedestal is formed by hand without fasteners or with minimal fasteners and may fold flat for packaging, shipping, storage, or the like.

20 Claims, 15 Drawing Sheets

(56) References Cited

U.S. PATENT DOCUMENTS 5,291,674 A 3/1994 Torrence
5,582,293 A * 12/1996 Kay ..... B65D 5/4204 206/457
5,775,046 A 7/1998 Fanger et al.
6,732,858 B1 * 5/2004 Chang Ou ..... A47B 87/0276 206/278
7,316,459 B2 1/2008 TenBrink
7,360,784 B2 4/2008 Stewart et al.
7,552,981 B1 * 6/2009 Tuniewicz ..... E05D 15/507 16/231
8,967,739 B2 3/2015 Jensen et al.
2014/0028167 A1 * 1/2014 Hui ..... A47B 43/02 312/262

* cited by examiner

MODULAR DISPLAY CASE

CROSS-REFERENCE TO RELATED APPLICATION

This application claims priority to and is based on U.S. Patent Application No. 62/003,614, filed May 28, 2014, entitled "Modular Display Case," the entire disclosure of which is incorporated herein by reference in its entirety.

FIELD OF INVENTION

The present invention relates to display cases for use in displaying and protecting products, and in particular, to modular, multipurpose display pedestals and display cases that can be used to create custom display units or display solutions.

BACKGROUND

Display cases and display pedestals are used in residential and commercial applications to display prototypes, art, photographs, sculptures, memorabilia and other such items. Display cases typically enclose or surround an item for display while pedestals sit beneath an item in order to support an item a distance above a support surface, such as the floor or ground. However, since display cases and display pedestals are frequently used to display large works of art such as visual art and collectible art, many display cases and/or display pedestals are generally large and bulky. Consequently, it may be troublesome, space consuming, time consuming, and/or costly to load, disassemble, ship, and/or setup large display and pedestal units.

Furthermore, large display cases and pedestals typically require a large number of parts or pieces and, thus, the chances of the display case or pedestal case being rendered useless when a critical part or piece goes missing or breaking rendering might increase as the size of the display case or pedestal increases. Additionally, many existing display case units or pedestal system units only provide either a display case or a pedestal system, not both. Accordingly, a multipurpose display case and pedestal that may be easily assembled and disassembled is desired.

SUMMARY

According to at least one embodiment of the present invention, a display case includes a base, a top, and a foldable outer wall configured to be removably coupled to the base and the top and extend therebetween. The base, the top, and the foldable outer wall collectively provide an internal cavity configured to receive objects for display when the outer wall is coupled to the base and the top. The foldable outer wall includes a door panel configured to provide selective access to the internal cavity and three or more wall panels. The door is configurable to open in at least two directions to provide the selective access, the three or more wall panels are rotatably coupled together, and one of the three or more wall panels is rotatably coupled to the door panel. The foldable outer wall is reconfigurable between an extended configuration, a storage configuration, and at least two use configurations.

BRIEF DESCRIPTION OF THE DRAWINGS

Like reference numerals have been used to identify like elements throughout this disclosure.

DETAILED DESCRIPTION

Generally referring to FIGS. 1-14, a modular display case according to the present invention is shown. The modular display case is multi-functional and may be used as a traditional display case (i.e. an object may be stored and/or displayed therein) and/or as a pedestal (i.e. an object may be displayed sitting atop the modular display case). Additionally, and as is described below in detail, at least a portion of the modular display case of the present invention may be easily or conveniently collapsible or otherwise foldable, such that the modular display case may collapse, fold or be easily disassembled for convenient transport, packaging, set up and/or take down. In addition, the modular display case of the present invention is interconnectable, insofar as "interconnectable" is simply intended to mean that any desirable number of modular display cases may be stacked or connected together, both horizontally and vertically, to create any shape or size display, pedestal, storage area, or other desirable area. In some embodiments, the display area (i.e. the interior of the display case) may be expanded when the cases are stacked or connected. The foldable and interconnectable nature of the present modular display case makes this an ideal solution for trade show applications.

Figure 1:
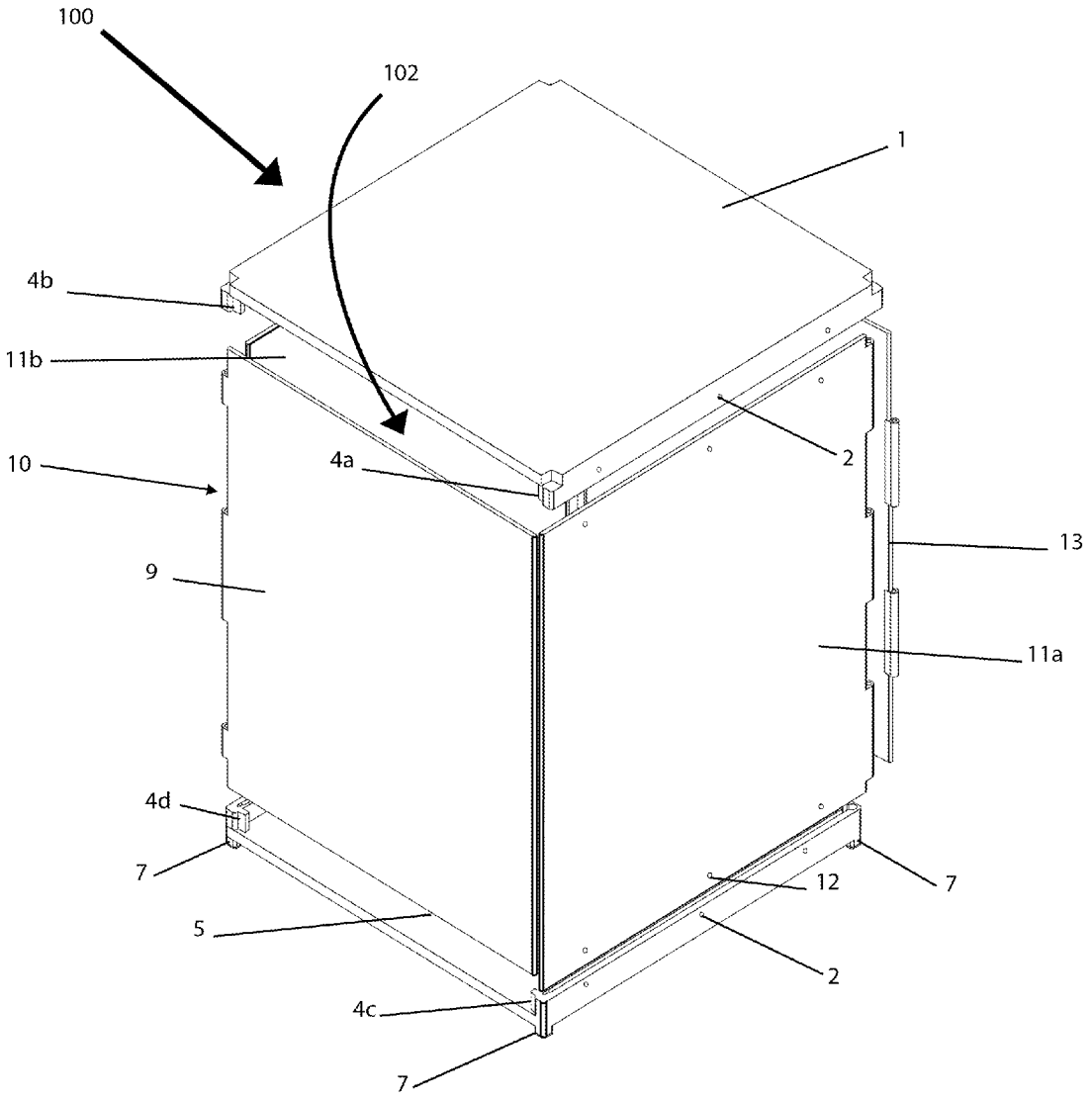
FIG. 1 is a semi-exploded perspective view of a modular display case according to one exemplary embodiment of the present invention, the modular display including a base, a top, and a door and panels extending between the base and top.

An embodiment of the modular display case according to the present invention is illustrated in FIGS. 1-10. Referring to FIG. 1 a display case 100 is shown. As shown, in this embodiment, the display case 100 has a base 5, a top 1, and an outer wall 10. In this embodiment, the outer wall 10 includes a door 9, and three panels 11*a*, 11*b*, 13, however, it is to be understood that each of door 9, panel 11*a*, panel 11*b*, and panel 13 may be referred to herein simply as a panel of outer wall 10. Each of the panels 11*a*, 11*b*, 13 and the door 9 extend between the base 5 and top 1 and, collectively, the panels 11*a*, 11*b*, 13 and door 9 form a foldable or segmented outer wall 10. Together, the outer wall 10, base 5, and top 1 form an interior cavity 102 that is configured to receive an item or object for display.

In this particular embodiment, the base 5 and top 1 are each substantially rectangular and each of the panels of the outer wall 10 (i.e., side panels 11*a* and 11*b*, rear panel 13 and door 9) extend along one of the peripheral edges of the rectangular base 5. Consequently, the interior cavity 102 is substantially cuboidal in this embodiment. However, in other embodiments, the display case 100 may include any number of panels, of any shape, arranged between base 5 and top 1 in any desirable arrangement to provide an internal cavity 102 of any desirable shape and size. Moreover, in the illustrated embodiment, the outer wall 10 does not extend between the base 5 and top 1 flush to the peripheral edges of base 5 and top 1 (instead leaving a small lip at the edge), but in other embodiments, the outer wall 10 may be disposed flush to the peripheral edges of base 5 and top 1 if desired. Regardless, the display case 100 has an overall size and shape configured to provide and/or allow for both horizontal and vertical stacking.

Figure 2:
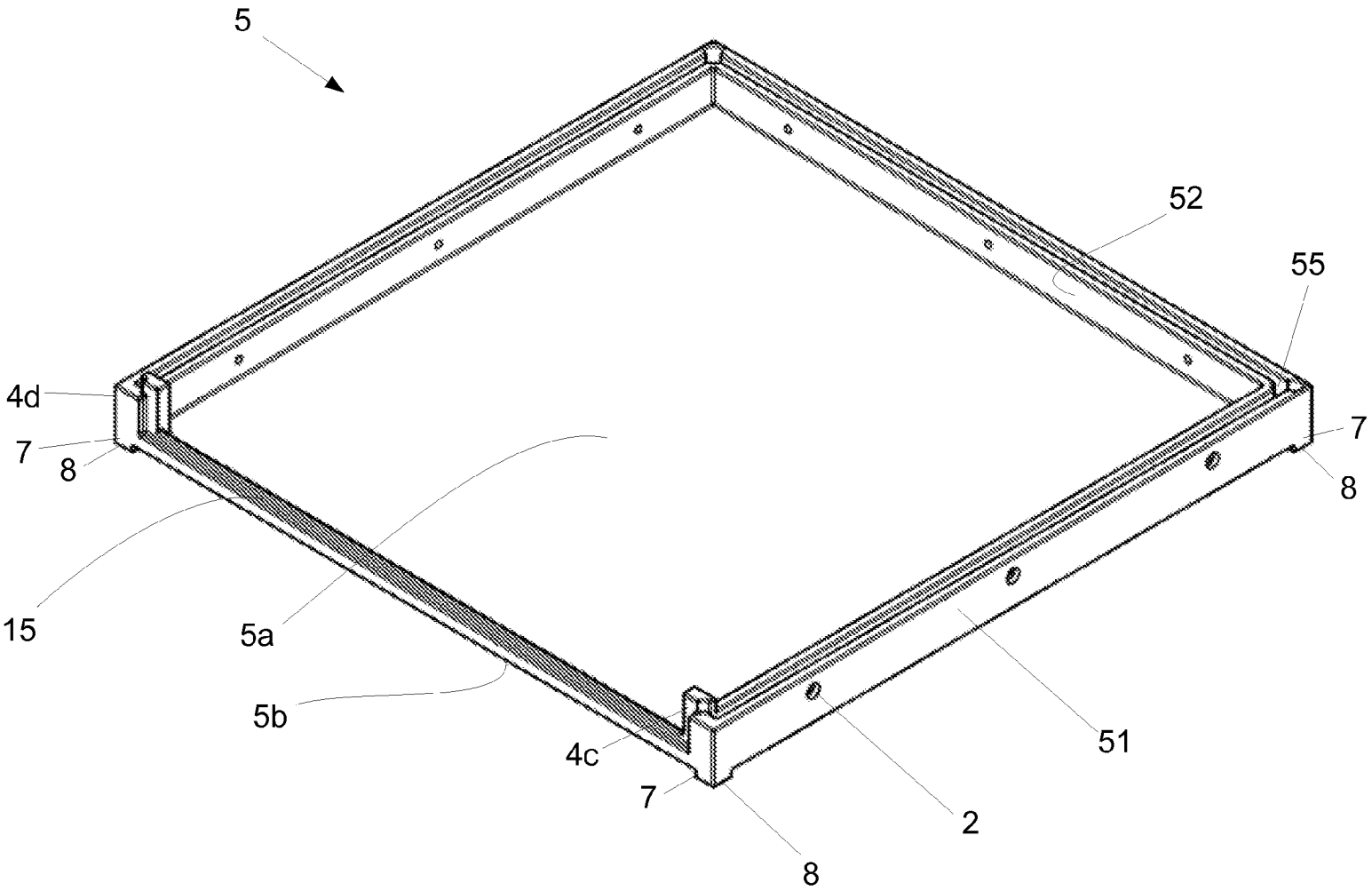
FIG. 2 is a top perspective view of the base of the modular display case of FIG. 1.

Turning now to FIG. 2, an exemplary base 5 is shown. As can be seen, base 5 has an upper surface 5*a* and a lower surface 5*b*. The base 5 also includes rails 50 extending along the peripheral edges of the upper surface 5*a* of the base 5 and bumpers 7 extending downwards from the lower surface 5*b*. Each of the rails 50 includes an outer portion 51 and an inner portion 52 which extend parallel to each other but at a distance apart such that a gap 55 configured to receive a panel 11*a*, 11*b*, 13 extends therebetween. In this particular embodiment, the base 5 includes three rails 50 bordering the sides and rear of the base 5 and each of the rails 50 is configured to receive any desirable panel 11*a*, 11*b*, 13. The rails 50 may also include any desirable number of openings 2. In some embodiments, the openings 2 may only extend through the outer portion 51 such that a locking mechanism, fastener, or other such fastening device may be inserted therethrough and engage a panel 11*a*, 11*b*, 13 resting in the gap 55, but in other embodiments openings 2 may extend through both the outer portion 51 and inner portion 52. In preferred embodiments, the openings 2 extend through the inner portion 52 and the outer portion 51 such that the openings may be used as a conduit configured allow electrical components, mounting components, or any other desirable components to pass through the case discretely, examples of which is described below with regards to FIGS. 11-14.

In embodiment illustrated in FIG. 2, the outer portion 51 of the rails 50 is flush with the peripheral edge of the base 5 such that the outer wall 10 is received slightly offset from the peripheral edge of base 5 when the outer wall 10 is received in the gap 55. However, in other embodiments, the rails 50 may be configured to receive the outer wall 10 in any desirable position. For example, in some embodiments, the rails 50 may be configured to secure the outer wall 10 to the base 5 adjacent to the peripheral edge of the base 5 by providing a rail 50 without an outer portion 51 and only securing the outer wall 10 to an inner portion 52. Accordingly, in some embodiments, the rails may not actually provide a gap 55 and, instead, may be configured to secure the base 5 to the outer wall 10 in any desirable manner. However, in those embodiments which include a gap 55, the gap may be shaped and sized as desired. In some embodiments, the rails 50 may include irregularly shaped gaps 55 configured to receive any features or parts of outer wall 10, an example of which is described below in detail with respect to FIG. 9B.

Still referring to FIG. 2, in some embodiments, the base 5 includes bumpers 7 extending downwards from the bottom surface 5*b* of the base 5. In this embodiment, the base 5 includes four bumpers 7 extending downwards from the bottom surface 5*b*, one at each corner of the base 5. However, in other embodiments, the base 5 may not include bumpers 7 or may include any desirable number of bumpers 7 arranged in any desirable arrangement. In this particular embodiment, each of the bumpers 7 is substantially cuboid-shaped, but in other embodiments the bumpers 7 may be any desirable shape and size. Regardless of the shape and size, any bumpers 7 included on case 100 are preferably configured so that the bottom surface 5*b* of the base 5 may either be elevated above a support surface that the display case 100 is placed upon or engaged with top 1 of another display case 100 that it is stacked atop of. Additionally, in this embodiment, each of the bumpers includes an anti- or non-slip tip 8 to prevent the display case 100 from sliding when sitting atop of a support surface or second display case 100. In some embodiments, the bumpers 7 may also serve as a locking mechanism when stacking a first modular display case 100 on top of another modular display case 100. As described below, in embodiments that allow vertical stacking, bumpers 7 may be configured to connect or fit into receivers 3 included in the top 1 (see FIG. 3).

In the embodiment of base 5 illustrated in FIG. 2 the base 5 also includes door stops 4*c*, 4*d* configured to support or engage a portion or portions of the door 9 and a lip 15 extending between the door stop 4*c*, 4*d* (along an edge of the base 5 that may be referred to as the front edge). In this particular embodiment, the lip 15 includes a number of raised bumps or indentations extending upwards from the top surface 5*a* of the base 5, similar to a rumble strip on a roadway, such that the lip 15 provides tactile vibrations as the door 9 is closed. By comparison, the door stops 4*c*, 4*d* extend inwards from the inner portion 52 of rails 50. In other embodiments, stops 4*c* and 4*d* may be included on and/or extend from any part or portion of case 100, such as the side panels 11*a*, 11*b* or the top surface 5*a* of the base 5. Moreover, in some embodiments the stops 4*c* and 4*d* may include mounted or built in magnets or any other desirable mechanism or feature configured to secure door 9 in its closed position. Alternatively, door stops 4*c*, 4*d* may simply be rubber door stops configured to support door 9 and, perhaps, frictionally secure door 9 in a closed position. The lip 15 may also be configured to engage a door 9 when the door 9 is moved to a closed position. As an example, in the embodiment shown in FIG. 2, a door 9 may engage the lip 15 as it is moved into a closed position and cam past one of the door stops 4*c*, 4*d* until the door is disposed substantially behind the door stop 4*c*, 4*d* and thereby frictionally locked in a closed position.

Figure 3:
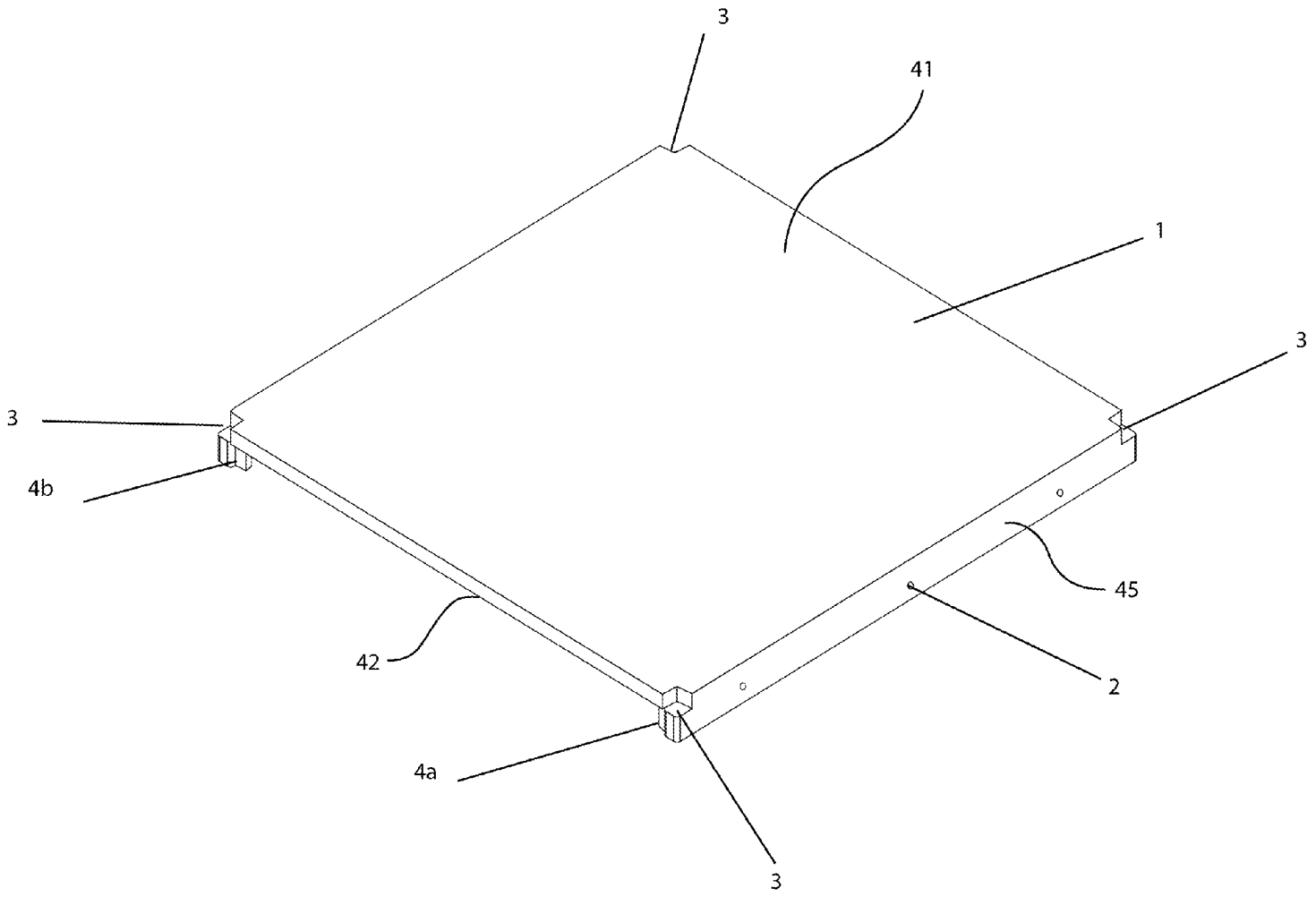
FIG. 3 is a top perspective view of the top of the modular display case of FIG. 1.

Now turning to FIG. 3, the top 1 of the modular display case 100 is shown. As can be seen, top 1 includes a top surface 41 with receivers 3 formed therein and a bottom surface 42. The top 1 also includes rails 45 which are substantially similar to rails 50 of FIG. 2, such that the description of rails 50 above applies to rails 45 (e.g., rails 45 may include an inner portion, an outer portion, a gap, openings and any of the other features discussed above with respect to rails 50 of FIG. 2), except that in contrast with the rails 50 included on base 5, rails 45 extend downwards from the bottom surface 42 (instead of upwards from a top surface). In this embodiment, the rails 45 included in top 1 extend along three of the four edges of the top 1 and receivers 3 are included in each corner of the top surface 41 of the top 1. Also similar to the base 5 of FIG. 2, although not shown in FIG. 3, in some embodiments, the top 1 may include a lip similar to the lip 15 of FIG. 2.

In FIG. 3, the receivers 3 are arranged to mirror and/or mate with the bumpers 7 included on a base 5 and the rails 45 are arranged to mirror and/or mate with the rails 50 included on a base 5. Accordingly, the rails 45, 50 may be configured to engage the top and bottom edges of panels 11*a*, 11*b*, 13 in order to secure the outer wall 10 between the base 5 and the top 1 while the receivers 3 may be configured to receive and secure the bumpers 7 included on a base 5 when two cases 100 are vertically stacked together (e.g., for display) or when a single base 5 is stacked with its corresponding top 1 for storage. In other embodiments, any desirable arrangement of receivers 3 and rails 45 may be included, but preferably, these features are configured to enable stacking for display and/or decrease the overall footprint of the components of display case 100 during storage.

Still referring to FIG. 3, the top 1 may also include door stops 4*a*, 4*b* that are similar to the door stops 4*c*, 4*d* in shape, size, function. The door stops 4*a*, 4*b* may also include mounted or built in magnets that may be configured to secure door in its closed position. In the depicted embodiment, the base 5 and top 1 provide four door stops 4*a*, 4*b*, 4*c*, and 4*d* that may collectively support and/or secure door 9 at four points when door 9 is in a closed position. However, in other embodiments, any desirable number of door stops may be included such that the door 9 may be supported by any number of door stops.

Figure 4:
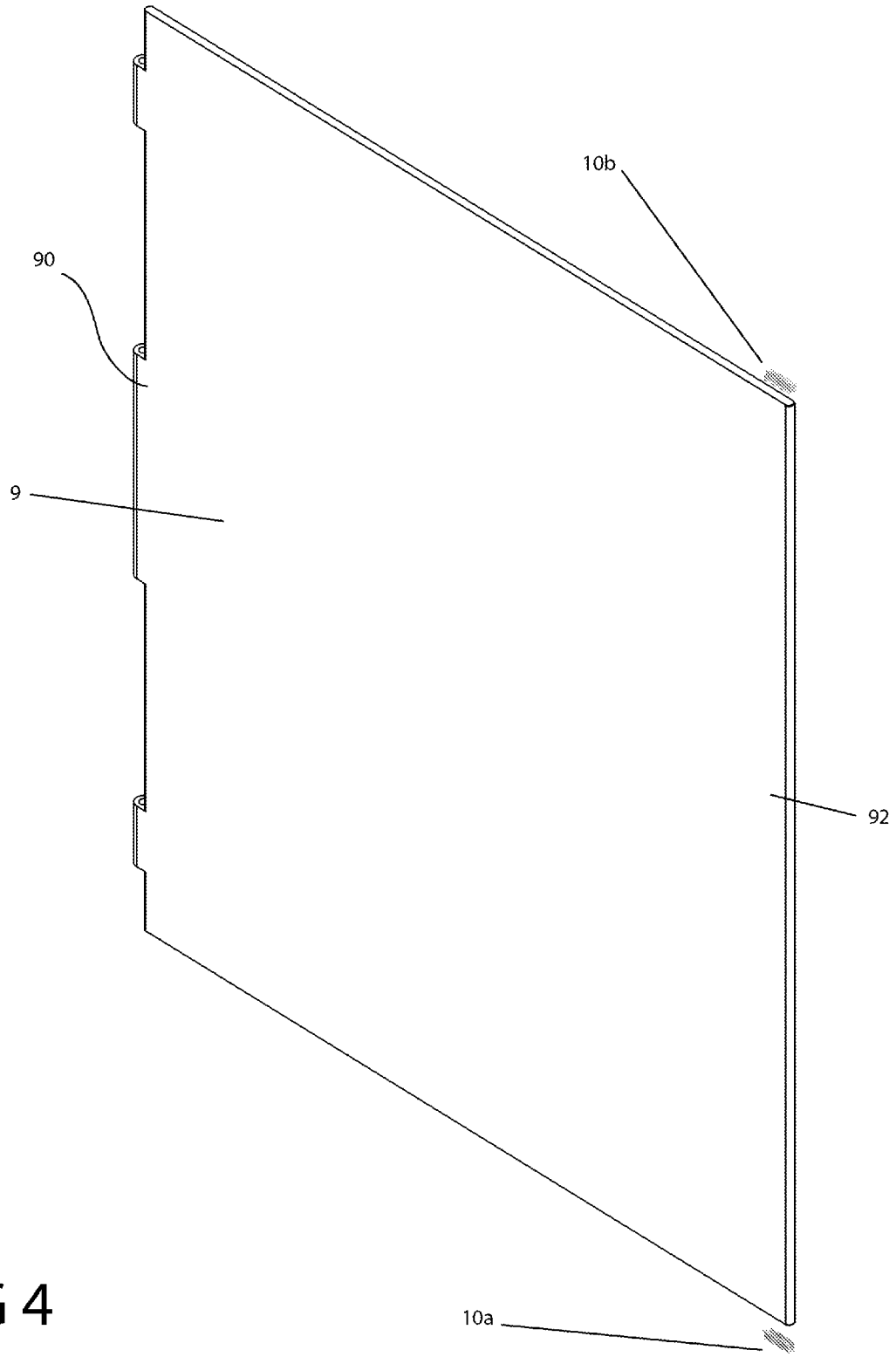
FIG. 4 is a front perspective view of the door of the modular display case of FIG. 1.
Figure 5:
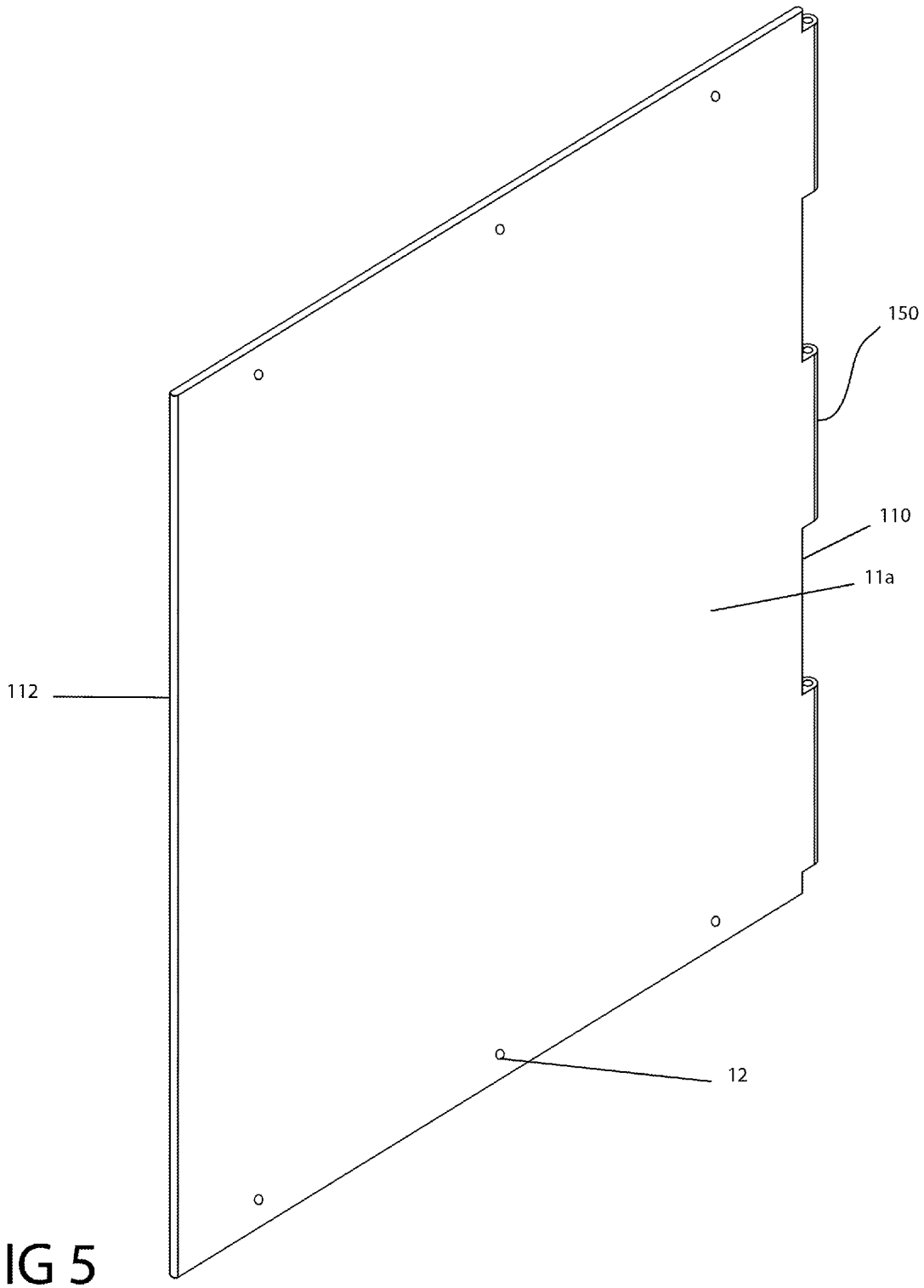
FIGS. 5-7 are front perspective views of the panels of the modular display case of FIG. 1.
Figure 6:
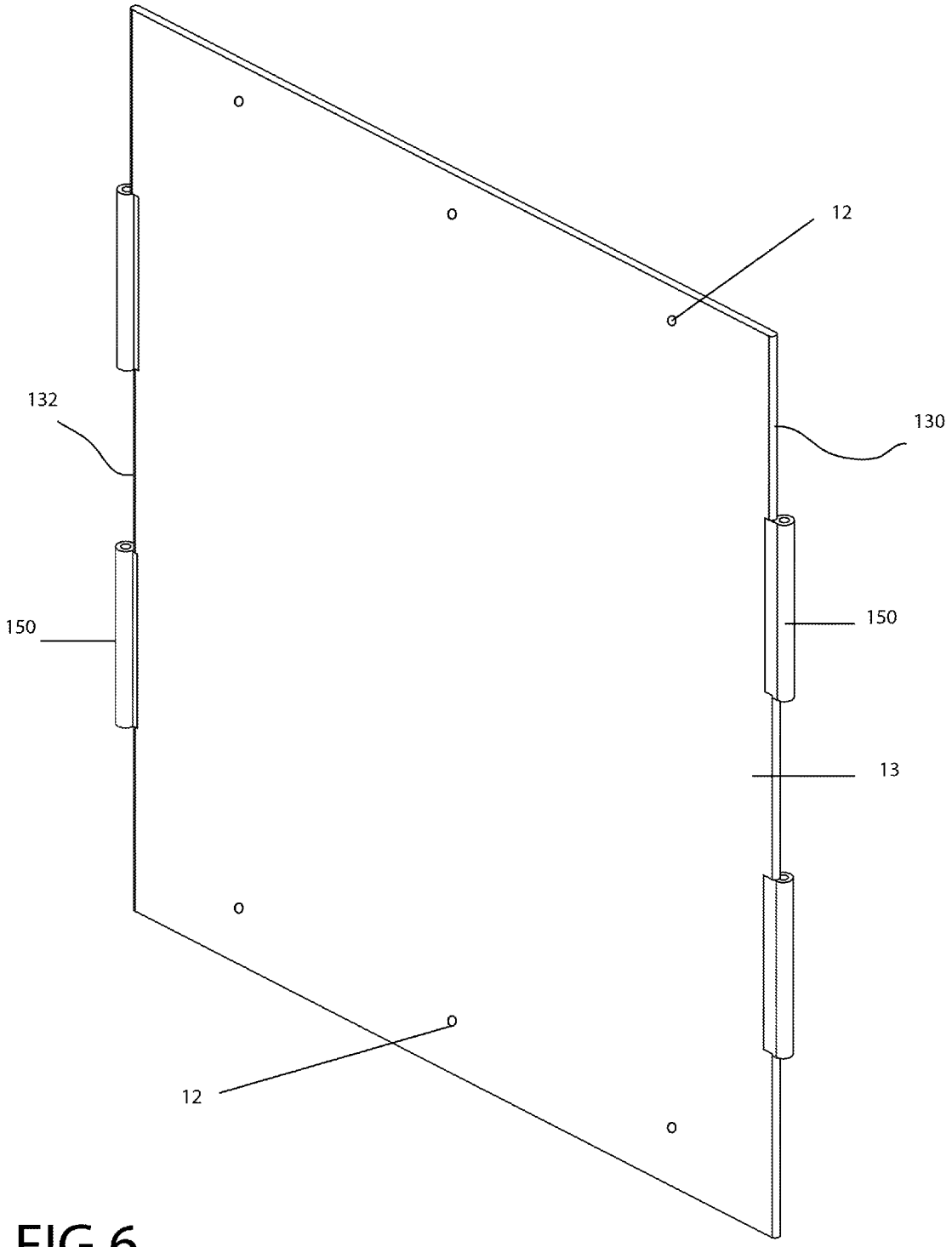
Figure 7:
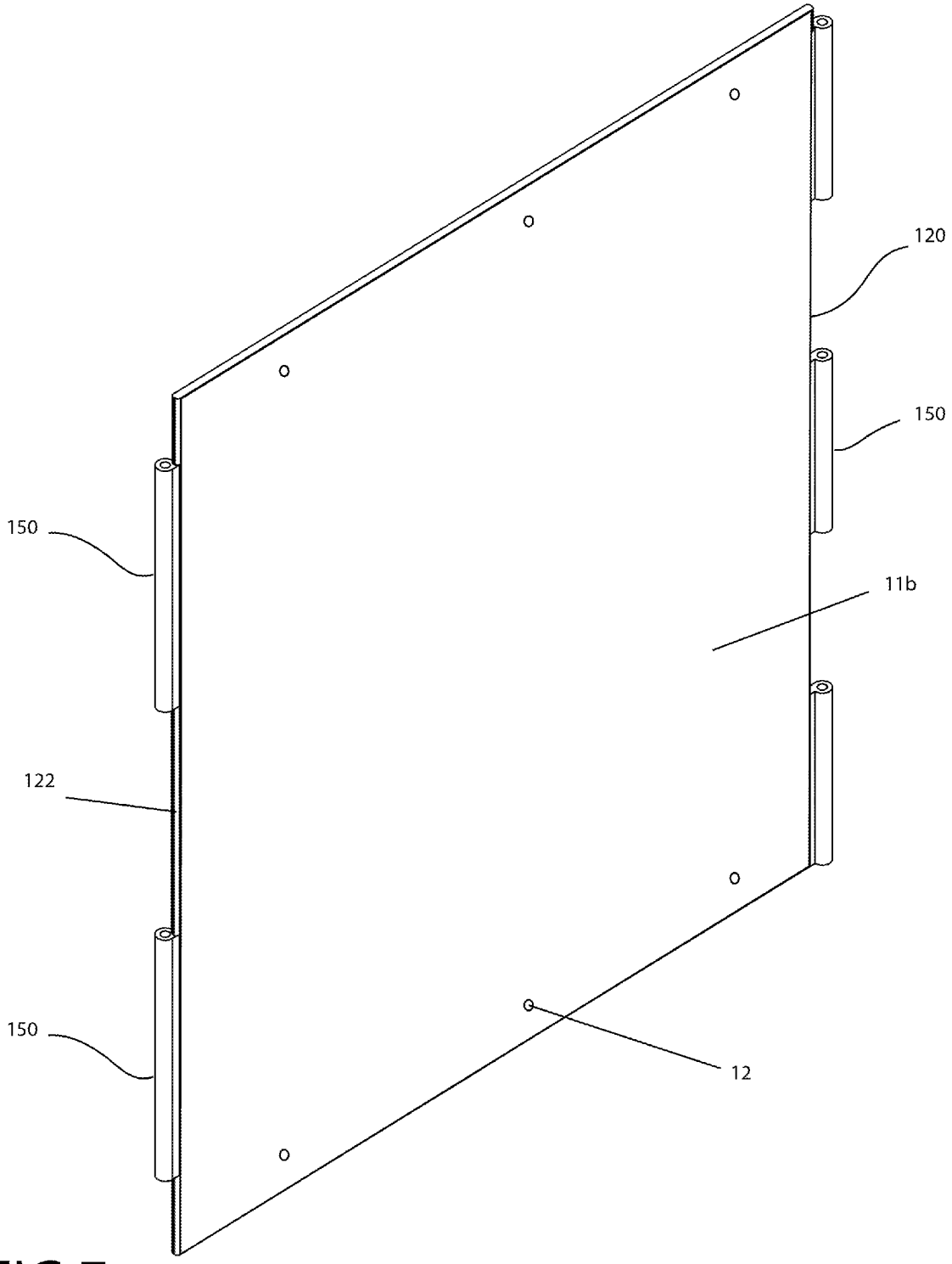

Referring next to FIG. 4, door 9 is shown. As can be seen, in this embodiment, the door 9 is a substantially flat panel which extends from a first edge 90 to a second edge 92. In this embodiment, the first edge 90 is a mating edge while the second edge 92 is a non-mating edge, insofar as "mating" implies that the first edge 90 is configured to be coupled, perhaps via removable fasteners, to other panels while "non-mating" implies that the second edge 92 is only configured to rest adjacent to or abut another panel, as is described below in further detail. Accordingly, the door 9 may be configured to be pivot about the first edge 90 such that the door 9 may be opened and closed by rotating the second edge 92 about or around the first edge 90. Although the first edge 90 is shown on the left side of FIG. 4, it is to be understood that in other embodiments, the first edge 90 (i.e., the mating edge) may be rotated to or disposed on any side (i.e. the top, bottom, right, or left) of the door 9. Alternatively, in other embodiments, the door 9 may include multiple mating edges and may be configured to open in any desirable manner. For example door 9 may, in some embodiments, be configured as a two swinging doors, if desired.

Additionally, in this embodiment, the door 9 includes securing members 10*a*, 10*b* configured to removably couple the second side 92 to at least one of panel 11*a*, 11*b*, 13, base 5, or top 1, as desired. In some embodiments, securing members 10*a*, 10*b* may be built into, formed integrally with, or otherwise included in the door 9, but in other embodiments, securing members 10*a*, 10*b* may be formed separately from door 9 and subsequently coupled thereto. In this particular embodiment, the securing members 10*a*, 10*b* are either magnetic strips or include magnetic properties and the doors are formed with the securing members 10*a*, 10*b* installed therein. Consequently, the door 9 may be magnetically coupled to door stops 4*a*, 4*b*, 4*c*, and 4*d* included on the base 5 and top 1 to secure door 9 in its closed position without requiring any user modifications or assembly.

More specifically, when the door 9 is oriented to open to the left (i.e. the second edge 92 is on the right when viewed from outside of the display case 100), securing members 10*a*, 10*b* may engage and removably couple door 9 to door stops 4*a*, 4*c* to secure door 9 in a closed position. Then, if the door 9 is turned around so that the door 9 is oriented to open to the right (i.e. the second edge 92 is on the left when viewed from outside of the display case 100), securing members 10*a*, 10*b* may engage and removably couple door 9 to door stops 4*b*, 4*d* to secure door 9 in a closed position (unless the entire case 100 is inverted in order to flip the door 9, then the door 9 may continue to engage stops 4*a*, 4*c*). However, in embodiments which do not include stops 4*a*, 4*b*, 4*b*, 4*c*, the securing members 10*a*, 10*b* may be configured to removably secure the door 9 in a closed position in any desirable manner. Moreover, in some embodiments, the securing members 10*a*, 10*b* and/or the second edge 92 may also include a pull handle, grip, or other graspable feature in order to ensure that a user can easily grasp and open the door 9 when desired. Such a feature may be preferable when the securing members 10*a*, 10*b* removably secure the door 9 in a closed position.

Now turning to FIGS. 5-8, panels 11*a*, 11*b*, and 13 and fasteners configured to secure panels 11*a*, 11*b*, and 13 in desirable positions are shown. As mentioned above, the panels 11*a*, 11*b*, 13 are configured to be secured to the base 5 and top 1 and extend therebetween. In some embodiments, the outer wall 10 is configured to be secured to both the base 5 and top 1 via fasteners, such as fasteners 17 (see FIG. 8). Accordingly, each of the panels includes apertures 12 which are preferably configured to align with openings 2. When the apertures 12 are aligned with openings 2, a fastener 17 (shown in FIG. 8), may be inserted through either rails 45 or 50 and into a panel 11*a*, 11*b*, 13 in order to removably secure the panel 11*a*, 11*b*, 13 to either the base 5 or top 1. However, in other embodiments, the rails 45, 50 may frictionally secure the outer wall 10 to the base 5 and top 1 such that fasteners are not required for assembly. Notably, even if fasteners, such as fasteners 17, are required or desired for assembly, the fasteners may be installed and removed by hand (without tools), such that the display case 100 is fully assembleable by hand whether or not fasteners 17 are used in the assembly.

In this particular embodiment, each of panels 11*a*, 11*b*, and 13, may be coupled to the base 5 and top 1 without any fasteners, however, for structural integrity as few as two fasteners (i.e. one fastener 17 for the base 5 and one fastener 17 for the top 1) and as many as six fasteners 17 (i.e. three fasteners 17 for the base 5 and three fasteners 17 for the top 1) may be used to further secure the outer wall 10 to the base 5 and the top 1. However, even when a minimal number of fasteners is used to further secure the outer wall 10 to the base 5 and the top 1, it is still preferred that each panel 11*a*, 11*b*, 13 includes a number and arrangement of apertures 12 that substantially matches the number and arrangement of openings 2 included on the top 1 and base 5. As mentioned above, such an arrangement may provide conduits through which electrical and mounting components can be passed when desired.

Moreover, it is to be understood that fastener 17 is merely exemplary and any desirable faster may be used to couple the outer wall 10 to the base 5 and top 1, provided the fasteners are removable and configured to be installed and removed without the use of any tools. In other words, fasteners 17 may be installed and removed by hand. In this embodiment, the panels 11*a*, 11*b*, and 13, door 9, and fasteners 17 may be primarily constructed from acrylic or other plastics, such as PLEXIGLAS, and fasteners 17 may be configured to snap into or out of engagement with the holes 2 and apertures 12 to couple or decouple the outer wall 10 to the base 5 and top 1 when inserted therethrough or pulled therefrom, respectively.

Still referring to FIGS. 5-8, each portion or panel of the outer wall 10 may include any desirable combination of mating edges and non-mating edges. In this embodiment, the panels 11*a*, 11*b*, 13 and door 9 of the outer wall only include mating and non-mating edges at their lateral edges while including edges with apertures 12 at their longitudinal edges, but in other embodiments, the panels of outer wall 10 may be configured as desired. More specifically, in this embodiment, the first side panel 11*a* includes a first edge 110 that is a mating edge and a second edge 112 that is non-mating, while the second side panel 11*b* includes a first edge 120 and a second edge 122 that are each mating edges and rear panel 13 includes a first edge 130 and a second edge 132 that are each mating edges). Preferably, the mating edges provide a hinged or rotatable connection between the panels of outer wall 10; however, any movable relationship may be incorporated into various embodiments of the present invention.

In order to provide a moveable relationship between the panels of the outer wall 10, any desirable mating feature, coupler, or connector which allows a mating edge of a first panel to be removably coupled to a mating edge of a second panel may be included on the mating edges of panels 11*a*, 11*b*, and 13 and door 9. In this particular embodiment, the mating edges included on the various panels 11*a*, 11*b*, 13, as well as door 9, include annular receivers 150 configured to align and receive an axle, rod, or other such connector. More specifically, the receivers 150 included on the various panels 11*a*, 11*b*, 13, as well as door 9, are preformed portions of hinges, insofar as preformed implies that the receivers 150 are formed integrally with the panels.

As seen best in FIGS. 4-7, in this embodiment, the first edges 110, 120 of panels 11*a* and 11*b*, as well as the first edge 90 of door 9, the receivers 150 are preformed hinge portions that each include three annular openings spaced evenly apart while the first and second edges 130, 132 of the rear panel 13 and the second edge 122 of panel 11*b* each include two annular openings 150. Preferably, the mating edges with two receivers 150 are configured to align with the mating edges including three receivers 150, such that the two receivers 150 may be disposed in the gaps between the three receivers 150. In other words, the mating edges of any panels included in the outer wall are preformed hinge portions that, when coupled together, are configured to provide a hinge between the two adjacent mating portions.

Figure 9A:
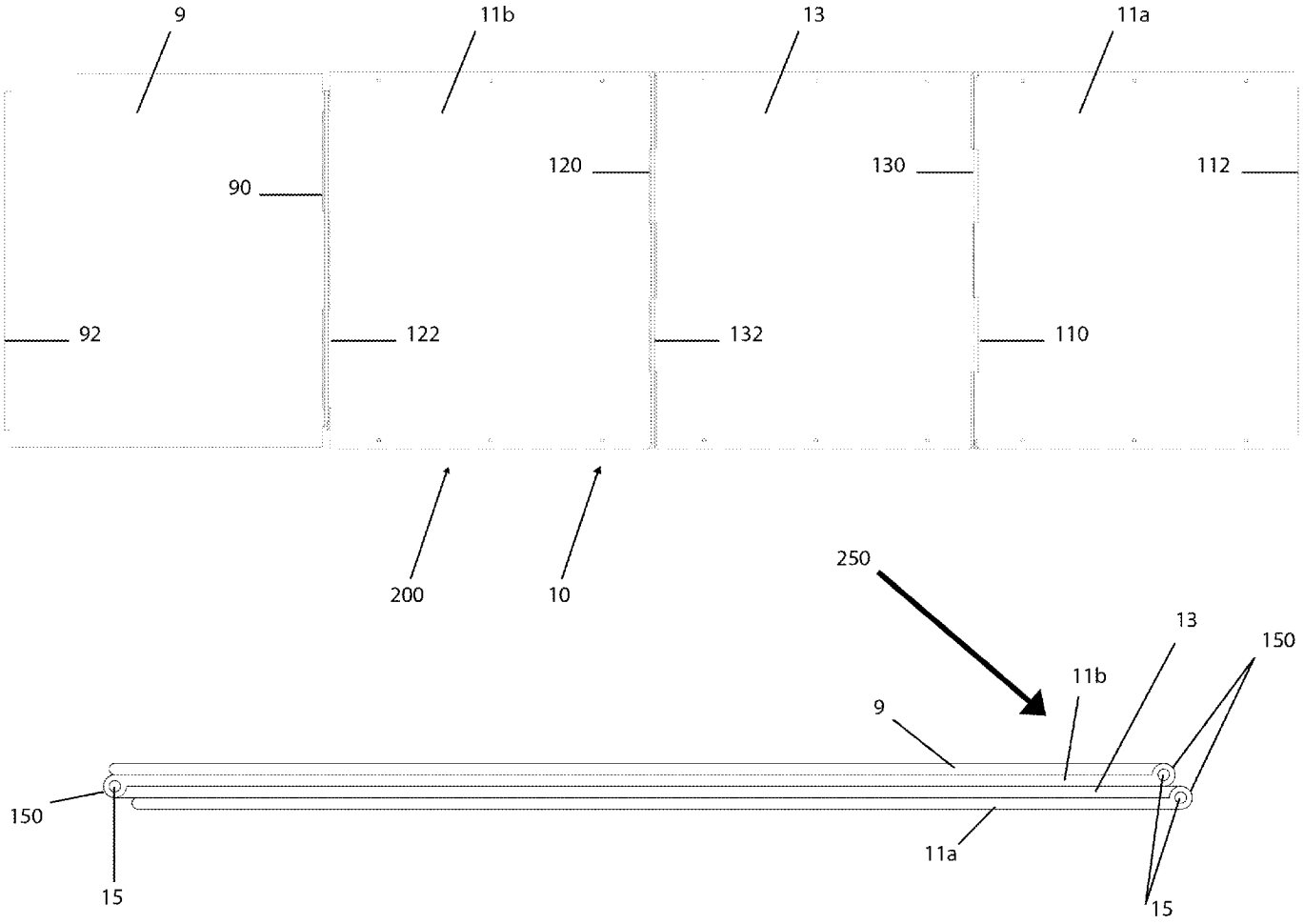
FIGS. 9A-B shows the panels and door from FIGS. 4-7 in various configurations.
Figure 9B:
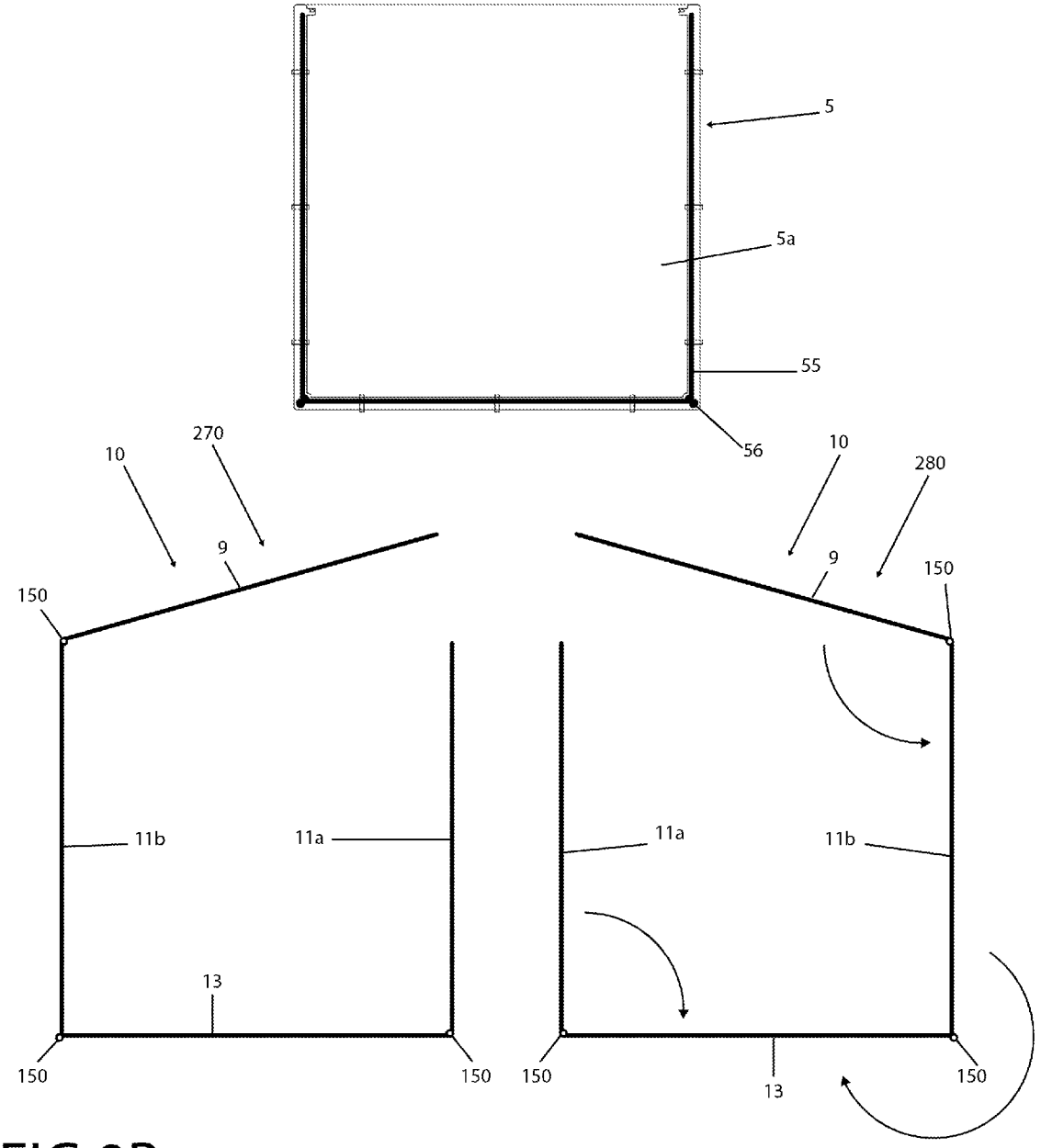

As seen best in FIGS. 9A-B, in the illustrated embodiment, the receivers 150 included on the edges 130, 132 of the rear panel 13 may be arranged to fit between the receivers 150 included on the first edges 110, 120 of panels 11*a*, 11*b*, such that the first edges 110, 120 of panels 11*a*, 11*b* abut the edges 130, 132 of the rear panel 13 (as seen in the extended configuration 200 shown in FIG. 9). Similarly, the two receivers 150 included on edge 122 of panel 11*b* may fit within the three receivers 150 included on the first edge 90 of door 9 such that the first edge 90 abuts the second edge 122 of panel 11*b*. When the panels are arranged as such, a single faster, such as rod 15 may be inserted through each group of aligned receivers 150 in order to rotatably couple two panels together. Thus, the panels 11*a*, 11*b*, 13, and door 9 may be formed into outer wall with three rods 15. In other words, the outer wall 10 may include seven total pieces (i.e., four panels and three rods). However, in some embodiments, these seven pieces may be coupled together as one outer wall 10 during manufacturing/production.

Due to the aforementioned configuration (i.e., the aligned receivers 150 being coupled together with rods 15), the outer wall 10 may move between an extended configuration 200, a storage configuration 250, a first use configuration 270, and a second use configuration 280, as shown in FIGS. 9A-B. More specifically, the rotatable connections between the panels allow the outer wall 10 to extend in a straight line in the extended configuration 200, form a substantially square wall in the first and second use configurations 270, 280, and also fold substantially flat in their storage configuration 250, without removing the rods 15 from within the receivers 150. Accordingly, the outer wall 10 may ship with a small footprint and be easily unfolded to form the sides of a display case 100.

In order to reduce the footprint of the outer wall 10, one group of receivers 150 is preferably disposed on a first side of the outer wall (e.g., the exterior of the outer wall) while the other two groups of receivers are disposed on a second side of the outer wall (e.g., adjacent the interior cavity), as seen best in the top plan views of outer wall 10 provided in FIG. 9B. This placement of receivers 150 allows the first side panel 11*a* to fold downwards (approximately 90 degrees) onto a first surface of the rear panel, the second side panel 11*b* to fold around (approximately 270 degrees) onto a second, opposite surface of the rear panel 13, and the door 9 to fold (approximately 90 degrees from its closed position) onto the second side panel 11*b*, in accordance with the directional arrows included in FIG. 9B.

However, at the same time, positioning the groups of receivers 150 in the orientation discussed above (e.g. one group of receivers 150 exterior of the outer wall 10 and two groups of receivers 150 interior of the outer wall 10) also causes the receivers 150 to extend slightly away form the outer wall 10 (in either direction) when the outer wall 10 is oriented in a use position, such as use positions 270, 280. In order to accommodate this arrangement of receivers 150, the base 5 and top 1 may include rails with irregularly shaped gaps, as seen best in FIG. 9B. Most notably, each corner of gaps 55 may include grooves 56 extending inwards and outwards from the gap 55. Preferably, grooves 56 each include an inner groove and an outer grove, as seen in FIG. 9B, such that the outer wall 10 may be received in either configurations 270 or configuration 280 (the receivers 150 may extend in either direction), however, in some embodiments, each groove 56 may only include an outer groove or an inner groove, such that it is only configured to receive outer wall 10 in either configuration 270 or 280. Alternatively, in still other embodiments, the receivers 150 may be aligned with the panels of the outer wall 10 (e.g., the receivers do not extend away from the outer wall 10) and the gap 55 may not include any grooves 56.

The configuration and features of the modular display case 100 described herein allow the display case 100 to be assembled and/or disassembled quickly, efficiently, and without any tools (i.e. the case may be built entirely by hand). The configuration and features of the modular display case 100 also serve to minimize the pieces or parts required for assembly, thereby rendering assembly, disassembly, shipping, packaging, etc. easier and cheaper. For example, in some embodiments, the base 5 and top 1 may be stacked together for shipping and the outer wall 10 may be stacked together with the base 5 and top 1 in its storage configuration 250 in order to provide the components in as flat of a position as possible. Once received, the components may be removed from the packaging, the outer wall 10 may be reconfigured into a user configuration 270, 280 and coupled to the base 5 and top 1. In some embodiments, the outer wall 10 may be frictionally coupled to the base 5 and top 1 by securing the outer wall 10 in the rails 45, 50.

Additionally or alternatively, the outer wall 10 may be coupled to or further secured to the base 5 and top 1 with as few as six fasteners 17 (i.e. two fasteners 17 per panel 11*a*, 11*b*, and 13) or as many as eighteen fasteners 17 (i.e. six fasteners 17 per panel 11*a*, 11*b*, 13, with three fasteners 17 coupling each panel 11*a*, 11*b*, 13 to the base 5 and three fasteners 17 coupling each panel 11*a*, 11*b*, 13 to the top 1). Preferably, the fasteners 17 may simply be inserted into and/or removed from the case 100 by hand, without the use of tools. Accordingly, an entire display case 100 may be assembled from a minimal number of parts, quickly and efficiently in a few steps without any tools. In fact, in some implementations, the rods 15 may be installed in the outer wall 10 before a case 100 is sold to a user, further simplifying the assembly and disassembly process.

In order to further simplify end-user assembly, in some embodiments, the outer wall may be shipped with rods 15 installed in the preformed hinges included in the outer wall 10. However, in other embodiments, the outer wall 10 may be assembled by aligning the panels 11*a*, 11*b*, 13 and door 9 in an extended configuration 200, inserting a rod 15 through each of the three groups of receivers 150 and then coupling the outer wall 10 to the base 5 and top 1. Regardless, if a preformed hinge or rod 15 was to break, the components may be separable by hand such that a single component could be removed and replaced without any tools.

The configuration and features of the modular display case 100 also allow multiple cases 100 to be stacked together horizontally and/or vertically. Accordingly, any desirable grid or arrangement of display cases 100 may be created. In embodiments with bumpers 7 and receivers 3, the bumpers 7 of a first display case 100 may be inserted into the receivers 3 of a second display case 100 when two cases 100 are vertically stacked in order to align and/or secure the cases in such a position. Alternatively or additionally, the display cases 100 may be secured in a desirable arrangement or grid with a few simple connectors. Specifically, in some embodiments, a second display case 100 may be coupled to a first display case 100 with as few as two pieces—two clips 18 or two pins 19. However, in some embodiments, these connectors are only used to further secure cases 100 stacked together via bumpers 7 and receivers 3, since receivers 3 and bumpers 7 may be sufficient to facilitate stacking without any further connectors.

Figure 8:
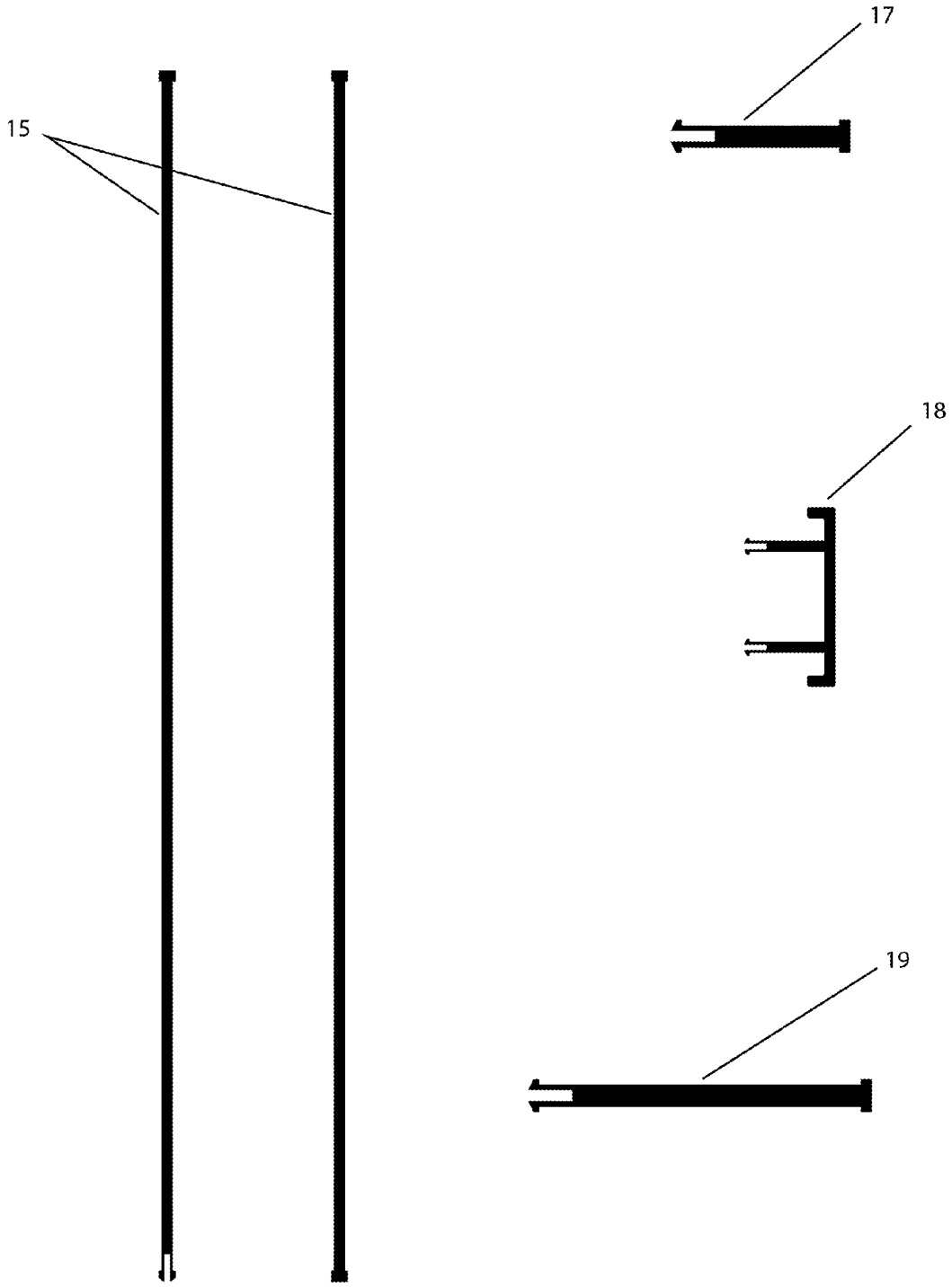
FIG. 8 is a top view of one exemplary embodiment of fasteners used to form the modular display case of FIG. 1.

In those embodiments which include clips 18 and pins 19, as shown in FIG. 8, these pieces may be used instead of or in addition to fasteners 17. For example, in the event that multiple modular cases 100 are stacked vertically, clip 18 may be used to secure the modular cases 100 together. The clip 18 is used by inserting the lower prong of the pin clip 18 into an opening 2 included on the top 1 of a first display case 100 while inserting the upper prong of the clip 18 into a hole 2 included on the base 5 of a second display case 100. Alternatively, if multiple display cases are to be connected horizontally, the pins 19, which are essentially elongated versions of fasteners 17, may be inserted through the holes 2 included in the bases 5 of two modular display cases 100, perhaps in place or instead of using fasteners 17. Since the apertures 12 of panels of the outer wall 10 are aligned with the openings 2, clips 18 and pins 19 essentially secure adjacent panels of the outer walls 10 together, facing each other when cases 100 are stacked horizontally and aligned with each other when cases 100 are stacked vertically.

Figure 10:
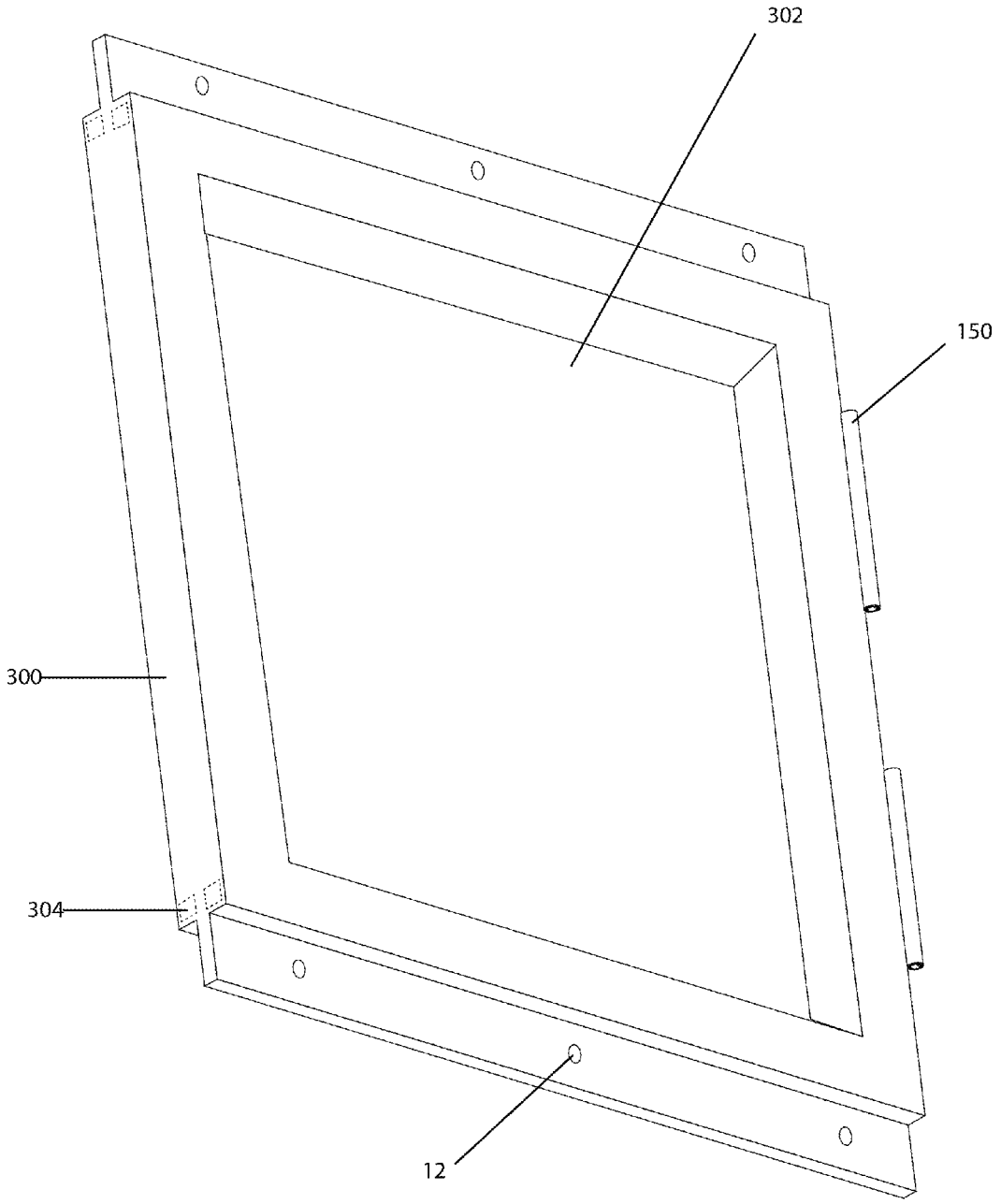
FIG. 10 shows an exemplary connector panel according to the present invention.

In some embodiments, it may be desirable to increase the size of the interior cavity 102 of the modular display case 100 when stacking or connecting cases 100. Accordingly, the modular display case 100 may also include a connector brace 300, as shown in FIG. 10, configured to allow the internal cavities 102 of two cases 100 to be merged to create a larger internal cavity 102. As can be seen, the connector 300 is an annular panel with an internal opening 302. Thus, when the connector 300 is substituted for a panel or panels of the display case 100, the display case may include an opening 302 to allow access to the interior cavity 102 and/or to allow the internal cavity 102 to be coupled to or merged with another internal cavity 102, thereby creating a larger internal cavity 102 to store and/or display larger objects.

Merging two cases with a connector 300 may also create a larger pedestal space by removing any gaps between the tops 1 of two cases 100. In other words, a single connector 300 may replace two adjacent panels from two adjacent display cases 100, thereby moving the cases closer together, as is explained below. However, it is to be understood that if two display cases 100 are arranged horizontally adjacent to each other without the use of a connector brace 300 any gap which may exist between the tops 1 may be closed or bridged in any desirable manner. For example, a small cap or cover may be included with a case 100 which may bridge a gap between the tops 1 of two display cases 100 stacked horizontally adjacent to each other. Alternatively, in some embodiment, gaps between the cases may be eliminated by disposing the outer wall 10 flush to the edges of top 1 and base 5.

In order to implement the connector 300, the abutting panels of two display cases 100 (i.e., panel 11*a* of a first case 100 and panel 11*b* of a second case 100) may be removed and replaced with a single connector 300. The connector 300 includes apertures 12 similar to the apertures 12 included on panels 11*a*, 11*b* and, thus, the connector 300 may be coupled to the base 5 and case top 1 in the same manner that the panels 11*a*, 11*b* are coupled thereto (i.e., by inserting a fastener 17 or pin 19 through the rails 45, 50 and the aperture 2). Additionally, in some embodiments, the connector 300 may include built in or mounted magnets 16 to secure panel doors 9 in a closed position, in addition to or in lieu of the door stops 14*a*, 14*b*, 14*c*, 14*d*.

Figure 11:
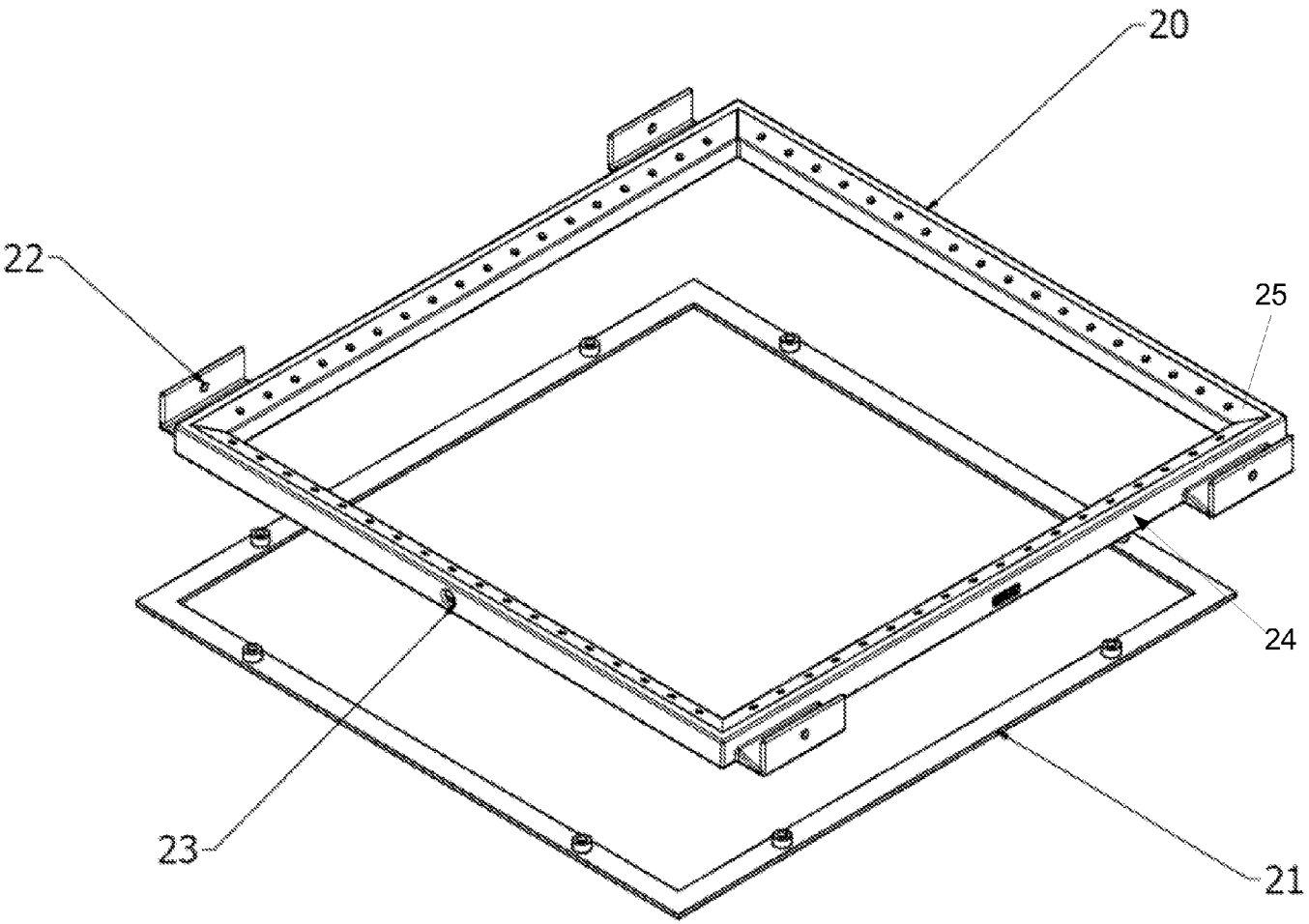
FIGS. 11-12 show an exemplary lighting insert according to the present invention, the lighting insert shown separate from the display case in FIG. 11 and shown installed in the base in FIG. 12.
Figure 12:
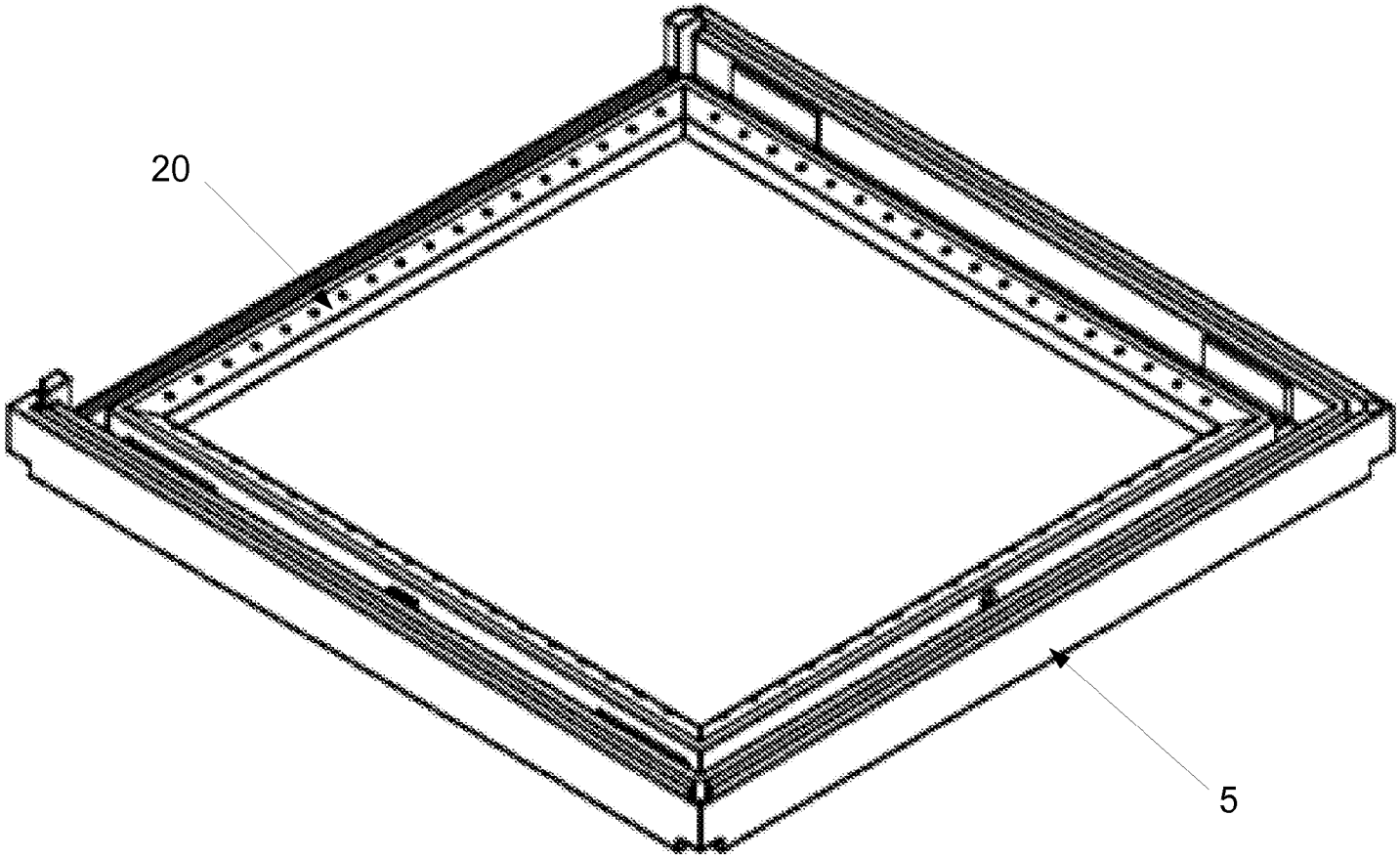

The modular case 100 may also include or incorporate a variety of desirable display features. For example, the modular display case 100 may include any desirable shelving or stands, lighting, display wheels, or the like. In some embodiments, this modular case may be fitted with lighting capabilities and a rotating display wheel which may be controlled by an electronic device. FIGS. 11-12 show one exemplary lighting insert 20 that may be included or incorporated into a display case 100. As can be seen in FIG. 11, the lighting insert 20 includes an annular support member 24 with a sloped top surface 25 that supports a number of LEDs 26 at an angle of approximately 45 degrees. The insert 20 also includes an opening 23 that is configured to align with an opening 2 and aperture 12 in order to allow electrical components, such as a power cord, of the insert 20 to extend through the display case and brackets 22 configured to align with features of the base 5 or top 1 for mounting. Specifically, the brackets 22 may align with openings 2 included in the base 5 or top 1, such that the insert 20 may, in some embodiments, be secured to the base 5 or top 1 with the same fasteners used to secure the outer wall 10 thereto (i.e., fasteners 17 or 19). The insert 20 may also include a support 21 configured to support the insert a distance above the top surface 5*a* of the base 5 or the bottom surface 42 of the top 1.

Figure 13:
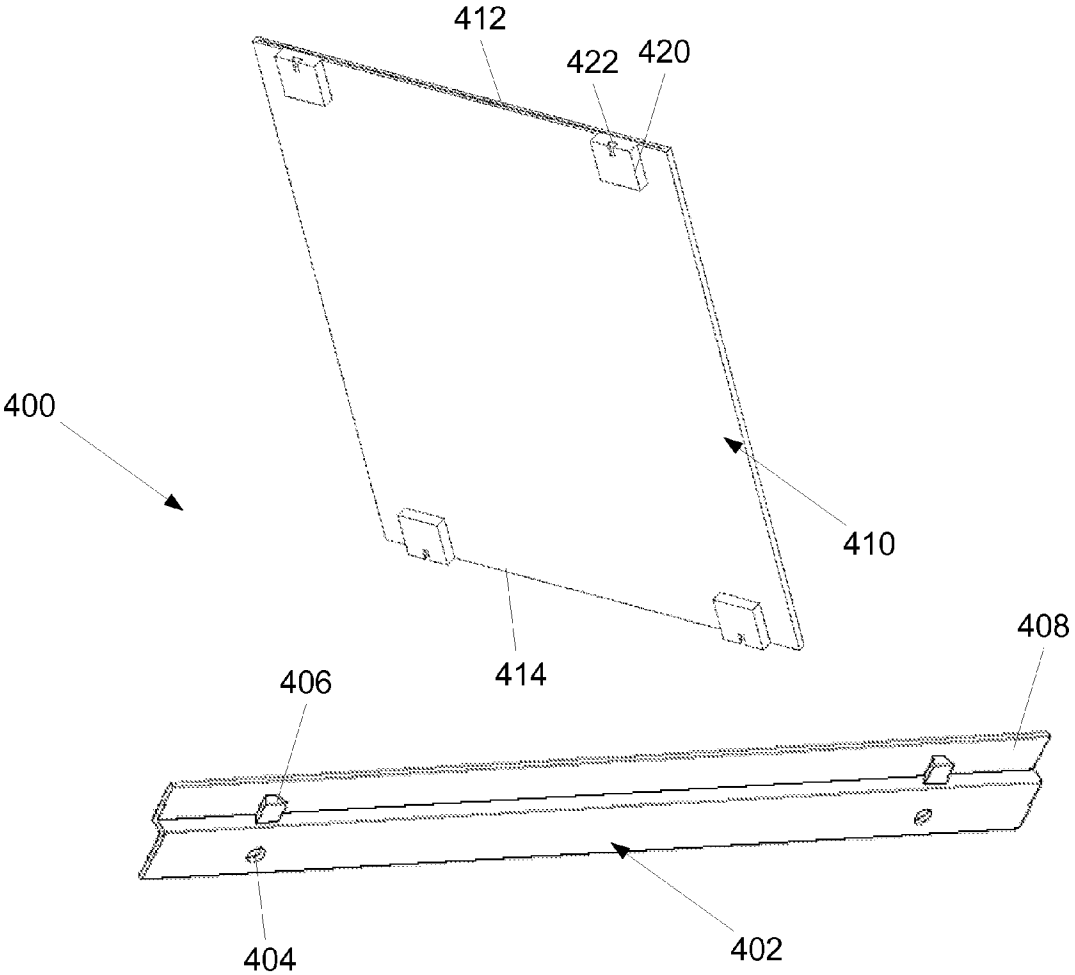
FIGS. 13-14 show an exemplary mounting according to the present invention, the mounting shown separate from the display case in FIG. 13 and shown installed in the base in FIG. 14.
Figure 14:
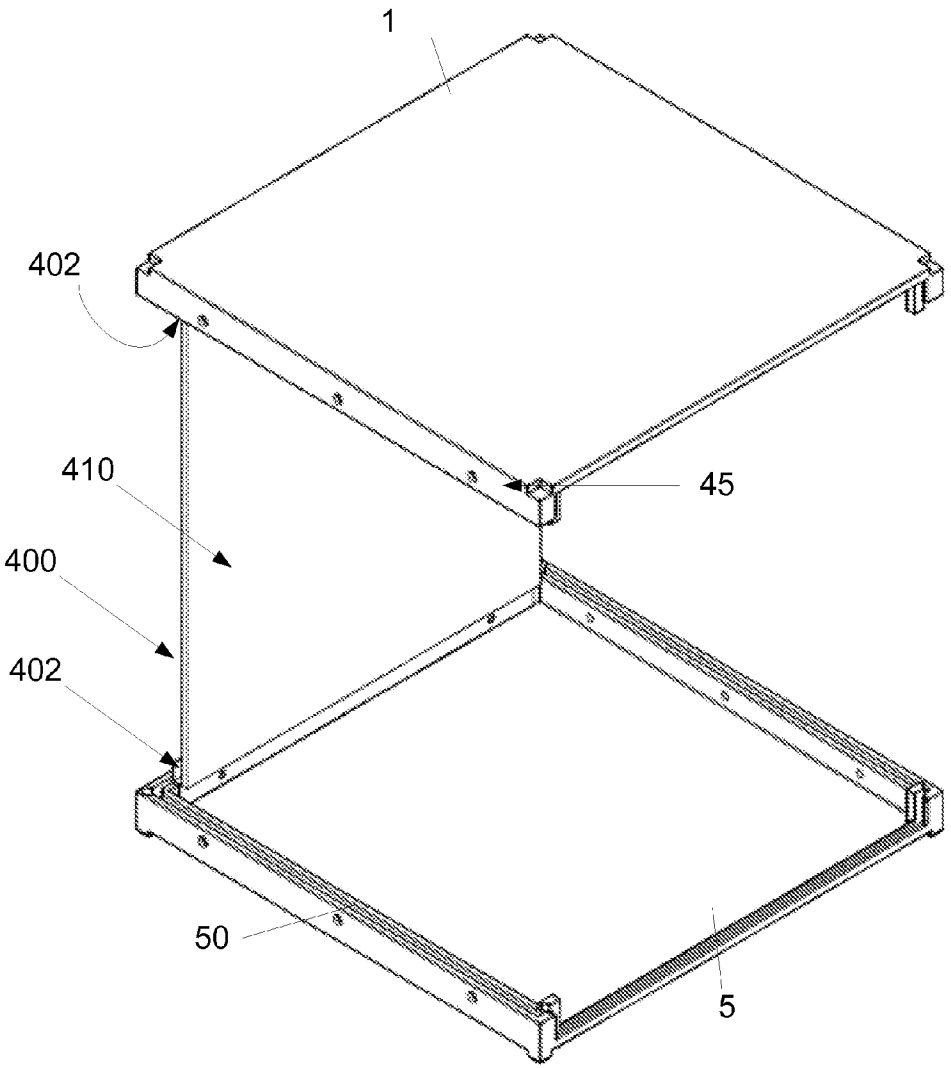

As an example of a shelving-type feature, FIGS. 13-14 illustrate an example art display that may be included with or installed onto a display case. FIG. 13 shows the art display 400 detached from the display case 100 and disassembled and FIG. 14 shows a partial display case 100 with the art display 400 installed therein. As seen in FIG. 13, the art display 400 includes a mount 402 and a display 410. Mount 402 includes an elongate body 408 with openings 404 and couplers 406. The openings 404 may be arranged to align with openings 2 and apertures 12, such that the art display 400 may be installed with or in place of a panel of the outer wall 10. The couplers 406 are configured to removably engage a mating feature of the display 410. In particular, the couplers 406 are configured to engage receivers 422 included on couplers 420 that are included adjacent top and bottom edges 412, 414 of the display 410. Consequently, although only one mount 402 is shown, two mounts 402 may be used to secure the art display 400 to the display case 100, as shown in FIG. 14.

The display 410 may be artwork or include any desirable features to display artwork such that including the art display 400 in the display case 100 may decorate at least a portion of the display case. In some embodiments, at least one face of the display 410 may be transparent or translucent and may include an opening in one of its edges 412, 414 that allows artwork to be inserted or installed into a cavity (not shown) included between the front and back faces of the display 410. For example, one surface of the display 410 may be completely transparent, the other side may be slightly opaque, and a print may be slid into the cavity therebetween such that the print is only viewable from one side. However, in other embodiments, both faces of the display may be transparent so that an item inserted into the cavity of display 410 may be seen from both sides.

To install the art display 400 on or into a display case 100, a mount 402 may be coupled to each of edges 412 and 414 by mating the connectors 406 with the corresponding receiver 422 and each mount 402 may be coupled to a corresponding portion of rails 45 and 50. In this embodiment, the receivers 422 may slide laterally onto the connectors 406 such that the display can be easily installed and removed from the mounts 402. Thus, any artwork included on or in the display 410 can be easily changed. Moreover, coupling mounts 402 to both edges 412, 414 may ensure any items disposed within the cavity of the display 410 are secured therein. In some embodiments, the mounts 402 are secured to the rails 45, 50 with the same fasteners used to attach the outer wall 10 thereto. In fact, in some embodiments, the art display 400 is installed in place of or adjacent to the back panel 13, such that any artwork mounted on or included on the art display 410 serves as a background to any items displayed in the case and viewed through door 9. However, since the art display 400 is removable and may be installed with the same components used to build or reconfigure the display case 100, the art display 400 may be installed adjacent to or in place of any desirable panel.

Now referring generally to FIGS. 1-14, the configuration and features of display case 100 allow the display case to serves as a pedestal or display case for any desirable purpose. When being used as a pedestal, an object may be placed atop of top 1, however, the modular display case 100 is also "invertable", insofar as invertable means that the display case may function when flipped upside down. Consequently, in some embodiments or uses, an object may also rest atop of the bottom surface 5*b* of the base 5 when the display case 100 is used as a pedestal. The invertable nature of the modular display 100 case also allows a user to switch the door 9 from opening right to left or left to right by simply inverting the entire display panel assembly 100. Accordingly, any reference to base 5 or top 1 serving as the top or bottom of the display case 100 may be understood to be interchangeable. For example, when stacking multiple display cases 100 vertically, the cases may be all be stacked upside down and the receivers 3 included on an upper case 100 may be fit onto the bumpers 7 included on a lower case 100.

However, despite the aforementioned invertable nature of case 100, some of the parts of display case 100, such as outer wall 10 and any panels included therein, may be individually invertable as well. Thus, in some embodiments, the door 9 may be switched between a left-to-right opening orientation and right-to-left opening orientation by only inverting the outer wall 10 or the door 9, not the entire case. In fact, preferably, only the outer wall 10 is inverted (i.e. flipped between configuration 270 and configuration 280) in order to switch the door between a left-to-right opening configuration and right-to-left opening configuration. Accordingly, and as described above with regards to FIG. 9B, the rails 45, 50 may be configured to receive the outer wall in either the first use configuration 270 or the second use configuration 280.

Additionally, the modular display case 100 may include switch out panels, insofar as switch out implies that each panel of outer wall 10 may be individually removed, replaced, repaired, etc. Thus, if one panel of outer wall 10 has a defect, breaks, or is simply no longer desirable (perhaps due to its color), a user may remove and replace a single panel instead of replacing the entire display case 100. Similarly, each panel of outer wall 10 may be capable of receiving inserts or panels of different colors and/or patterns if desired. Still further, each panel may be interchangeable as desired. As examples, the door 9 may be interchanged with a panel 11*a*, 11*b*, 13 to move the door location, an additional panel may replace door 9 to form a completely sealed display unit, or the display case 100 may include an open side, multiple doors, or multiple open sides, as desired. The modular display case 100 also has the ability to connect a backdrop, or graphics to the panels 11*a*, 11*b* and 13 by attaching them to the display case 100 through openings 2. Similarly, the modular display case 100 may also include or incorporate an exterior skirt to cover the case panels 11*a*, 11*b*, and 13 and the door 9. The skirt may also be attached via the openings 2 and may be preferred when the display case 100 is used as a pedestal.

In the view of the foregoing, present invention embodiments provide consumers and exhibitors with a modular display case that may be used in a multitude of configurations. For example, the present invention may be used as a stand alone pedestal or a base to attach additional display cases to, such that the present invention may provide display cases or pedestals at different height levels.

The present invention may also minimize the cost and hassles of obtaining and constructing a display case. The present invention provides a convenient, easy to use, display case with easily interchangeable parts. The door of the present display case may open either right to left or left to right. Alternatively, the display case can either be used as a display case with an opening or secure panel instead of a door so that the display case provides an open display or a completely enclosed display, respectively. Moreover, the various panels of the outer wall of the display case may be interchangeable, perhaps for panels of different colors, tinting, etc. The display case may also include or incorporate fabrics as external skirts or internal backdrops if so desired, and the fabrics may be secured to the display case via the same openings used to secure the panels of the outer wall to the base and top. Graphic film positives may also be attached to the panels through the case holes if desired.

Furthermore, the present display case is modular, insofar as multiple display cases may be stacked vertically and horizontally and coupled together in a stack in order to provide display spaces of any desirable shape and size. In some of these embodiments, the internal space of multiple cases may be joined horizontally and/or vertically with the use of a merging bracket to create a larger internal space. The present display case may also be placed individually if desired. Consequently, the present display case may be used to create any desired furnishing for either residential or commercial use. Such uses may include, but not be limited to, end tables, coffee tables, entertainment centers, and other such furnishings. Additionally, shelving may be added within display cases, as desired.

Generally referring to FIGS. 1-12, any part or portion of display case 100 may be fabricated from any suitable material, or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include highdensity polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed:

1. A display case comprising:

a base including a set of rails extending upwardly along at least a portion of a peripheral edge of the base, wherein the set of rails includes an outer portion, an inner portion, a gap formed between the outer portion and the inner portion, and at least one groove disposed adjacent one or more corners included in the gap;

a top; and a foldable outer wall configured to be removably coupled to the base via the set of rails, removably coupled to the top, and extend between the top and the base, such that the base, the top, and the foldable outer wall collectively provide an internal cavity configured to receive objects for display when the foldable outer wall is coupled to the base and the top, and wherein the foldable wall comprises:

a door panel configured to provide selective access to the internal cavity, the door panel being configurable to open in at least two directions to provide the selective access;

three or more wall panels, wherein the three or more wall panels are rotatably coupled together via preformed hinges included on the wall panels and one of the three or more wall panels is rotatably coupled to the door panel via one of the preformed hinges included on the wall panels, such that the foldable outer wall is reconfigurable between an extended configuration, a storage configuration, and at least two use configurations, wherein the at least one groove allows the preformed hinges to be received in the gap in each of the at least two use configurations.

2. The display case of claim 1, wherein the three or more wall panels comprise:

a first side wall panel including a first mating edge;

a second side wall panel including a second mating edge and a third mating edge;

and a rear wall panel including a fourth mating edge and a fifth mating edge; wherein the mating edges each include one of the preformed hinges, the first mating edge is configured to mate and be rotatably coupled with the fourth mating edge and the second mating edge is configured to mate and be rotatably coupled with the fifth mating edge.

3. The display case of claim 1, wherein the foldable outer wall is further removably coupleable to the base and top in the at least two use configurations with as few as six fasteners.

4. The display case of claim 3, wherein the as few as six fasteners are installable and removable by hand.

5. The display case of claim 1, wherein the outer portion is disposed flush to the peripheral edge of the base.

6. The display case of claim 1, wherein the base is substantially rectangular and the outer portion of the set of rails are disposed along three edges of the rectangular base.

7. The display case of claim 1, wherein the set of rails are a first set of rails and the top further comprises:

a second set of rails extending downwardly from a lower surface of the top, the second set of rails being arranged to mirror an arrangement of the first set of rails included on the base such that the first set of rails and the second set of rails are configured to receive and frictionally secure the foldable outer wall in the at least two use configurations.

8. The display case of claim 1, wherein, in the storage configuration, the three or more panels and the door are coupled together and folded substantially flat atop of each other.

9. The display case of claim 1, wherein at least one of the door panel and the three or more panels are each translucent panels.

10. The display case of claim 1, wherein, the door panel is configured to open in a first direction when the foldable outer wall is coupled to the base and the top in a first use configuration and the door panel is configured to open in a second direction when the foldable outer wall is coupled to the base and the top in a second use configuration, the second direction being opposite to the first direction.

11. The display case of claim 10, wherein the door panel is selectively securable in a closed position in the first use configuration and the second use configuration.

12. The display case of claim 10, wherein the foldable outer wall is reconfigurable between the first use configuration and the second use configuration by inverting the foldable outer wall with respect to the top and the base.

13. A set of display cases comprising:

at least two display cases, each display case comprising:

a base including two or more bumpers configured to support the display case a distance above a support surface;

a top including two or more receivers configured to receive the two or more bumpers from the base on another display case; and a foldable outer wall configured to be removably secured between the base and the top in order to provide an internal cavity configured to receive an object for display, wherein the foldable outer wall comprises:

a first unfoldable side wall panel including a first mating edge;

a second unfoldable side wall panel including a second mating edge and a third mating edge; and an unfoldable rear wall panel including a fourth mating edge and a fifth mating edge; wherein the mating edges each include at least a portion of a preformed hinge, the first mating edge is configured to mate and be rotatably coupled to the fourth mating edge, and the second mating edge is configured to mate and be rotatably coupled with the fifth mating edge, such that the foldable outer wall is configured to fold between an extended configuration and a storage configuration when removed from the top and the base, wherein, the two or more receivers of a first display case of the at least two display cases can receive the two or more bumpers of a second display case of the at least two display cases to vertically stack the first display case and the second display case.

14. The set of display cases of claim 13, wherein each of the first side wall panel, the second side wall panel, and the rear wall panel includes an inner surface and an outer surface, wherein the inner surfaces and outer surfaces of the at least three panels are aligned in the extended configuration and wherein at least one surface of each of the first side wall panel, the second side wall panel, and the rear wall panel abuts the inner surface or the outer surface of another one of the first side wall panel, the second side wall panel, and the rear wall panel when the foldable outer wall is disposed in the storage configuration.

15. The set of display cases of claim 13, further comprising at least two clips, the clips configured to be coupled to the top of the first display case and the base of the second display case when the first and second display cases are vertically stacked to further secure the first display case and the second display cases in a vertical stack.

16. The set of display cases of claim 13, wherein the set of display cases is horizontally stackable, the set of display cases being securable in a horizontally stack by securing the foldable outer wall of the first display case to the foldable wall of a third display case.

17. The set of display cases of claim 13, wherein the at least a portion of the preformed hinge is one or more annular receivers, the first mating edge is configured to mate and be rotatably coupled to the fourth mating edge by aligning the one or more annular receivers included on the first mating edge with the one or more annular receivers on the fourth mating edge and inserting a first rod therethrough, and the second mating edge is configured to mate and be rotatably coupled with the fifth mating edge by aligning the one or more annular receivers included on the second mating edge with the one or more annular receivers on the fifth mating edge and inserting a second rod therethrough.

18. A display case comprising:

a foldable outer wall including three or more unfoldable panels and a door, wherein the three or more unfoldable panels and the door are rotatably coupled together via joints that laterally extend inwardly or outwardly beyond the unfoldable panels and the door;

a top including a first set of rails extending downwardly along at least a portion of a peripheral edge of the top, wherein the first set of rails includes an outer portion, an inner portion, a gap formed between the outer portion and the inner portion, and at least one groove disposed adjacent one or more corners included in the gap, wherein the gap is configured to receive the three or more unfoldable panels and each of the at least one grooves is configured to receive one of the joints; and a base including a second set of rails extending upwardly along at least a portion of a peripheral edge of the base, wherein the second set of rails includes an outer portion, an inner portion, a gap formed between the outer portion and the inner portion, and at least one groove disposed adjacent one or more corners included in the gap, wherein the gap is configured to receive the three or more unfoldable panels and each of the at least one grooves is configured to receive one of the joints, wherein the base, the top, and the foldable outer wall collectively provide an internal cavity configured to receive objects for display when the foldable outer wall is coupled to the base and the top.

19. The display case of claim 18, wherein the foldable outer wall is reconfigurable between an extended configuration, a storage configuration, a first use configuration and a second use configuration, the at least one grooves in the top allowing the joints to be received in the top in the first configuration and the second configuration, and the at least one grooves in the base allowing the joints to be received in the base in the first configuration and the second configuration.

20. The display case of claim 18, wherein the joints extending inwardly in the first configuration extend outwardly in the second configuration and the joints extending outwardly in the first configuration extend inwardly in the second configuration.

* * * * *